United States Patent [19]

Harris

[11] 4,385,566

[45] May 31, 1983

[54] BURNER APPARATUS

[76] Inventor: Loren A. Harris, Rte. 1, Box 294, Montague, Calif. 96064

[21] Appl. No.: 330,684

[22] Filed: Dec. 14, 1981

Related U.S. Application Data

[62] Division of Ser. No. 140,712, Apr. 16, 1980, Pat. No. 4,323,017.

[51] Int. Cl.[3] ..... F23K 3/00

[52] U.S. Cl. ..... 110/110; 110/267; 110/327

[58] Field of Search ..... 110/110, 101 R, 267, 110/327

[56] References Cited

U.S. PATENT DOCUMENTS

| | | | |
|---|---|---|---|
| 1,922,960 | 8/1933 | Klein | 110/110 |
| 2,034,890 | 3/1936 | Wynn, Jr. | 110/110 |
| 2,056,478 | 10/1936 | Miller | 110/101 R |
| 2,067,583 | 1/1937 | Stark | 110/101 R |
| 2,122,733 | 7/1938 | Van Rijswijk | 110/110 |
| 2,141,764 | 12/1938 | Riddell | 110/110 |
| 2,143,328 | 1/1939 | Miller | 110/267 |
| 2,365,679 | 12/1944 | Casey | 110/110 |
| 2,452,453 | 10/1948 | Graham | 110/110 |

*Primary Examiner*—Henry C. Yuen

*Attorney, Agent, or Firm*—Kolisch, Hartwell & Dickinson

[57] ABSTRACT

Apparatus constructed to burn solid fuel within a firebox. The apparatus includes a burner having a receptacle and a jacket forming an air chamber about the receptacle. An air-supply conduit and a fuel conduit disposed concentrically therein are adapted to extend into the firebox. The burner is detachably mounted on the two conduits in cantilever fashion within the firebox, to communicate the air and fuel conduits with the jacket and the lower interior portion of the receptacle, respectively. Forced air supplied to the air chamber through the tube is vented into the upper region of the receptacle, to support combustion of fuel supplied to the receptacle through the fuel conduit.

3 Claims, 2 Drawing Figures

BURNER APPARATUS

CROSS-REFERENCE TO RELATED APPLICATION

This application is a divisional application of applicant's copending application Ser. No. 140,712 entitled "Burner Apparatus", filed Apr. 16, 1980, U.S. Pat. No. 4,323,017.

BACKGROUND AND SUMMARY OF THE INVENTION

The present invention relates to burner apparatus, and more particularly, to apparatus having a burner which is easily connected to fuel and air-supply conduits.

Heating devices such as furnaces and dryers which utilize solid fuel are well known. A typical solid-fuel heating device includes a burner located within a firebox, and conduits through which solid fuel and combustion-supporting air are supplied to the burner. With extended operation, combustion heat tends to warp or otherwise degrade the burner, requiring expensive and time-consuming burner replacement. Further, heat transfer from the burner to the device's fuel-supply conduit may produce fuel obstruction in the conduit with certain types of solid fuel.

One type of solid fuel which has been developed recently is pelletized biowaste, such as densified wood-waste pellets, having a 10% to 12% moisture content. Characteristically, the pelletized fuel swells during dehydration. Consequently, when the fuel is used in heating devices of the type described above, where significant heat transfer from the burner to the fuel-supply conduit occurs, the fuel may become significantly dehydrated and expanded within the conduit, producing fuel conduit obstruction. This problem has limited the use of fuel of this type in prior art solid-fuel heating devices, despite combustion efficiency and relatively low cost of pelletized biowaste fuel.

It is one general object of the present invention to provide, for use in a furnace or dryer firebox, a solid-fuel burner apparatus which substantially overcomes the just-discussed problems associated with prior art burners.

A more specific object is to provide such apparatus having a burner which is easily removed for cleaning and replacement.

Another object of the invention is to provide such apparatus constructed to reduce heat transfer to the fuel-feed components thereof.

Still another object of the invention is to provide apparatus in which ash and clinkers are diverted away from the apparatus.

It is another object of the invention is to provide such apparatus having a burner which is mounted in cantilever fashion within a firebox by detachable connection to fuel and air-supply conduits extending into the firebox.

The apparatus of the present invention includes an inner fuel-feed conduit and an outer, concentric air-supply conduit which is in heat-exchange relationship therewith. The conduits are adapted to extend into the firebox of a heating device. The burner in the apparatus includes a receptacle having an open top, and a jacket forming an air chamber about the receptacle. The fuel and air conduits are concentric and detachably fitted with annular means forming openings in the sides of the receptacle and jacket, respectively. The burner may be mounted in cantilever fashion by the conduits. Forced air supplied to the air chamber through the air conduit passes over lower portions of the burner and is vented into the upper region of the receptacle.

These and other objects and features of the present invention will become more fully apparent when the following detailed description of a preferred embodiment of the invention is read in conjunction with the accompanying drawings, wherein:

FIG. 1 is a top view of apparatus constructed according to the present invention; and FIG. 2 is a side view of the apparatus of FIG. 1, shown partially in section along line 2—2 of FIG. 1.

DETAILED DESCRIPTION OF THE INVENTION

Figure 1:
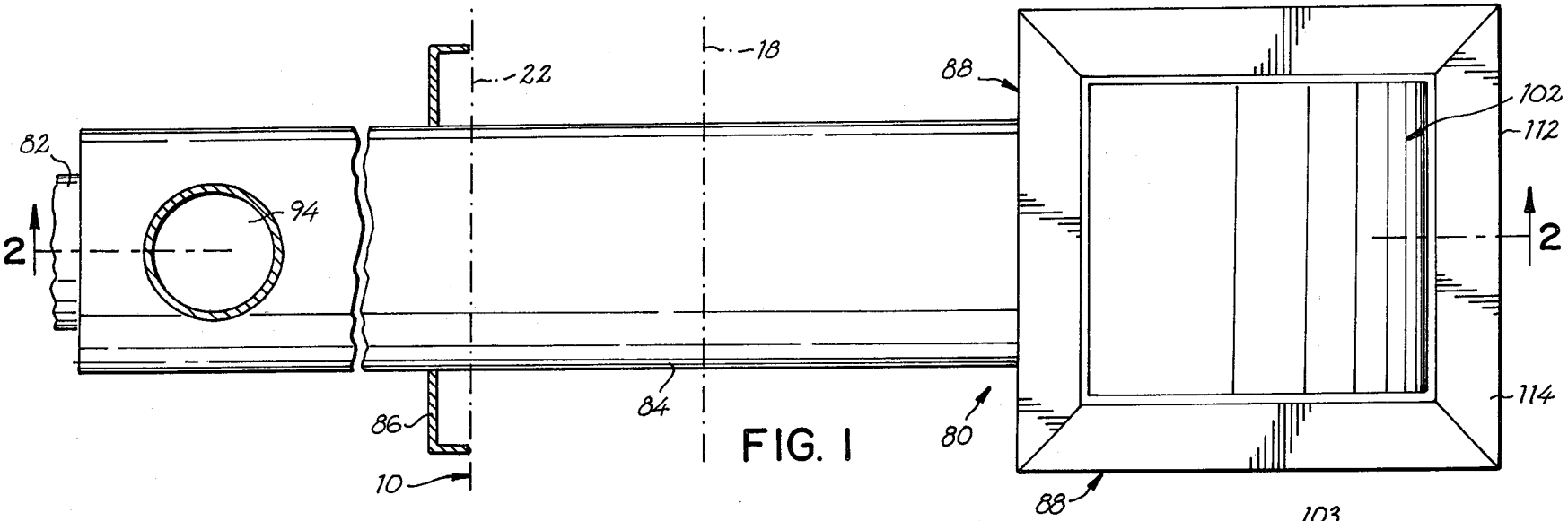

There is shown generally at 10 in the figures, a fragmentary side wall portion of a furnace which is equipped with a burner apparatus 80 constructed according to the present invention. The furnace includes an inner, annular, upright firebox wall, represented fragmentarily by dash-dot line 18, and an outer, annular, upright wall surrounding the firebox wall and represented fragmentarily in the figures by a dash-dot line 22. The inner and outer furnace walls define an annular air jacket (between lines 18, 22) through which air is circulated conventionally to heat the air as it passes upwardly through the annular jacket. Although the apparatus of the invention is shown and described for use in a furnace, it will be appreciated that the burner apparatus can be used advantageously in drying ovens, water heaters, and other devices where a controlled and efficient source of heat utilizing pelletized biowaste fuel is desired.

Apparatus 80 generally includes a fuel-supply conduit 82 and an air-supply tube, or conduit, 84 which is disposed concentrically about the right end portion of conduit 82 in the figures. Conduits 82, 84 extend through suitable openings in the inner and outer walls of the furnace. A collar 86 is used in securing conduit 84 to the outer furnace wall, as indicated. A burner, or burner unit, indicated generally at 88, is detachably connected to conduits 82, 84 in a manner to be described, and is supported therein within the furnace's firebox in cantilever fashion.

Figure 2:
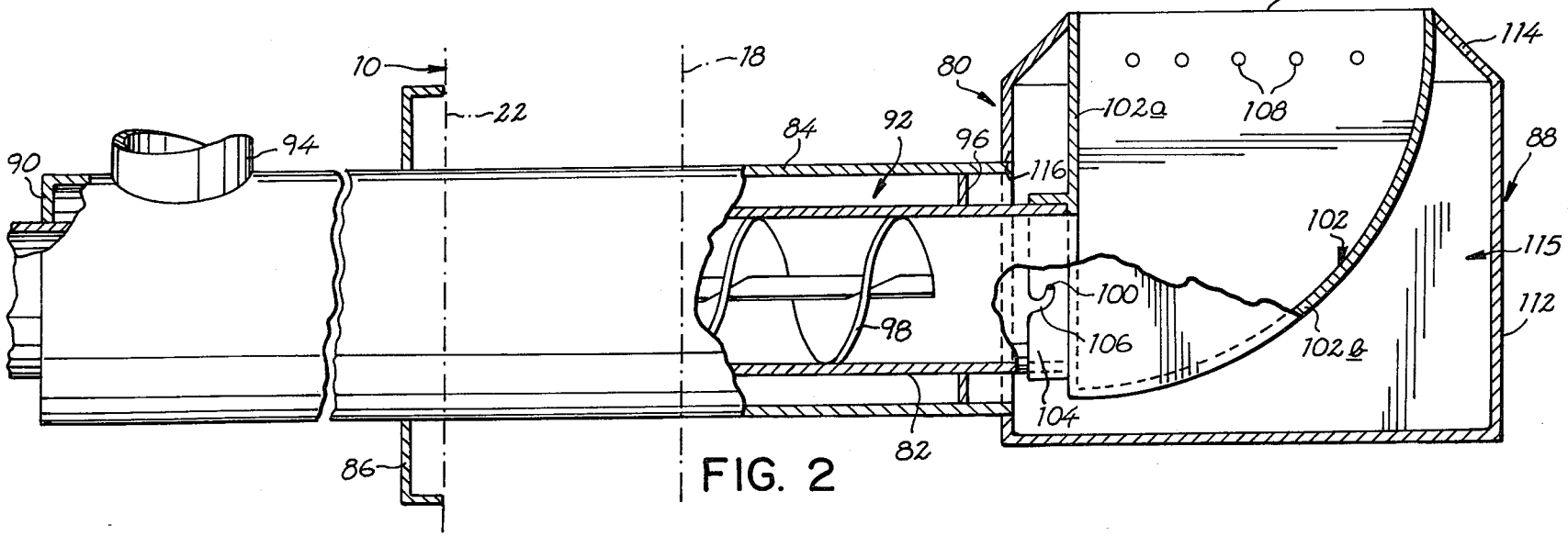

Conduit 84 which is formed of cylindrical metal tubing, is open at its right end, where the tube communicates with burner 88 (FIG. 2). The left end portion of the tube in the figures is bent inwardly to form an annular lip 90 (FIG. 2) which is sealed to the outer wall of the conduit 82. Forced air is introduced into the annular space between conduits 82, 84 by a forced-air blower (not shown) which communicates with the just-mentioned space through a pipe 94.

Conduit 82, which is also formed of cylindrical metal tubing, is held coaxially within conduit 84, at the tube's left end, by lip 90, and adjacent the tube's right end, by webs, such as web 96. Conduit 82 is supplied solid fuel, and preferably pelletized biowaste fuel of the type mentioned above, from a conventional fuel hopper. The fuel is transported in a left-to-right direction in the figures by an auger screw 98 rotatably mounted within conduit 82 and driven by a motor (not shown) located to the left of the furnace in the figures. As seen in FIG. 2, the right end of conduit 82 extends beyond the right end of conduit 84, and has attached thereto a pair of diametrically opposed pins, such as pin 100, for a purpose to be described.

Burner 88 includes a receptacle 102 having an open top 103. The receptacle takes the form of a cylindrical quadrant having a vertical front wall 102*a* and an inwardly concave rear wall 102*b* which slopes rearwardly progressing upwardly. It can be appreciated that the receptacle can be formed from a planar sheet metal pattern which is seamed, as by welding, at its abutting edges. A collar or annular means 104 on the lower central region of wall 102*a* in FIG. 2 defines an opening which communicates with the interior of the receptacle, and is dimensioned to receive the right end of conduit 82 slideably therein in a telescopic fit. A pair of diametrically opposed keyways, such as keyway 106, formed in the collar, coact with pins, such as pin 100 on conduit 82, to detachably lock the conduit to the collar with slight rotation of the burner relative to the conduit. When so locked, the burner unit is prevented from displacing axially with respect to conduits 82, 84.

Continuing with the description of receptacle 102, a plurality of apertures, such as apertures 108, are formed in the walls adjacent the receptacle's upper end region. These apertures, whose purpose will be described below, are also referred to herein as aperture means.

Receptacle 102 is encased in a box-like jacket 112 which has a four-sided upper wall portion 114, the upper edges of which are joined, as by welding, to associated edges forming the receptacle's upper opening. Like receptacle 102, jacket 112 can be formed from a planar sheet metal pattern which is seamed at its abutting edges.

An air chamber 115 formed between the receptacle and the jacket receives air from conduit 84 through an annular edge 116 defining a port formed in the left side of the jacket. Port 116 is dimensioned to receive the right end of conduit 84 snugly therein when conduit 82 is connected to collar 104. forced air supplied to chamber 115 is vented through apertures, such as apertures 108. Jacket 112 is also referred to herebelow as means defining chamber 115. Port 116 is concentric with, and larger than collar 104. This means that an axial projection of port 116 encompasses collar 104, whereby the collar is exposed at the front of the unit by port 110.

In operation, fuel in conduit 82 is transported through the conduit into the lower region of the receptacle, by the action of auger screw 98. The fuel introduced into the receptacle is urged toward the right in FIG. 2 against the lower portion of curved wall 102*b*. It can be appreciated in this figure that the curvature in the rear wall acts to guide the fuel upwardly toward the upper open end of the receptacle where combustion occurs. The preferred curvature of wall 102 is substantially that shown in FIG. 2, where the wall has a substantially circular arc in cross section. Where the wall has a substantially steeper curvature, fuel pellets being fed into the receptacle tend to become compacted in the lower region of the receptacle rather than being guided toward the receptacle's upper opening. Where the curved wall is relatively shallow, it has been found that the pelletized fuel is not well distributed in the upper portion of the receptacle.

The fuel in the upper portion of the receptacle is ignited, with combustion being supported by forced air introduced through tube 84 into chamber 115, and from chamber 115 into the upper portion of the receptacle through apertures, such as apertures 108. Here it is noted that combustion can occur only in the upper region of the receptacle, near its upper opening, since air is supplied to this region only.

The present invention is constructed particularly for use with pelletized fuel which is susceptible to dehydration and swelling upon heating. A number of constructional features in the present invention aid in preventing such fuel from heating and swelling as it is transported through conduit 82 toward the upper portion of receptacle 102. The fuel-supply conduit and lower portion of the receptacle are at all times during the operation of the burner cooled by a stream of relatively cool air surrounding the fuel conduit annularly and completely encompassing the receptacle below its upper opening. The receptacle and conduit, being maintained in a cooled condition during burner operation, also tend to warp less and last longer.

The configuration of the fuel supply pathway in the apparatus functions to prevent fuel blockage by facilitating movement of the fuel from the fuel-supply conduit to the upper portion of the burner apparatus, for reasons noted above.

According to another important feature of the invention, the burner can be easily attached to and detached from, in "plug-in" fashion, the fuel and air-supply conduits mounted on the furnace and extending into the furnace's firebox. Such allows for easy installation, replacement and interchangeability of burners of various sizes.

The apparatus is also constructed to promote removal of ash and clinker material produced by combustion, by such material tending to spill over the outwardly and downwardly extending wall portion 114 in the apparatus.

While a specific embodiment of the invention has been described herein, it is obvious that various changes and modifications can be made without departing from the spirit of the invention.

It is claimed and desired to secure by Letters Patent:

1. Burner apparatus comprising an elongate fuel conduit having a metallic and thus heat conductive wall defining a fuel passage for the supply of fuel, an elongate air conduit encompassing said fuel conduit, said air conduit and fuel conduit defining therebetween an air passage for the supply of air, the metallic and heat conductive wall of the fuel conduit separating the fuel and air passages whereby they are in heat exchange relation, the air and fuel conduits having open ends which face the same direction and are adjacent each other, a burner unit having a front and a rear, and including, an an integral assembly, a receptacle with an interior for holding fuel and an open top, a shell secured to and surrounding the receptacle defining an air chamber encompassing the receptacle, and aperture means in said receptacle for venting air from said chamber into the receptacle adjacent said open top, said burner unit further having a first annular means facing the front of the burner unit defining an entrance which passes through said shell and communicates with said air chamber, and a second annular means also facing the front of the burner unit defining an entrance which passes through said receptacle and communicates with the interior thereof, an axial projection of said first annular means encompassing said second annular means whereby the second annular means is exposed at the front of the unit by the first annular means, a concentric detachable fit of said open end of said air conduit with said first annular means, and a concentric detachable fit of said open end of the fuel conduit with said second annular means, and releaseable means detachably locking the end of at least one conduit to the annular means with which it is detachably fitted for preventing relative axial displacement of the burner unit from the fuel and air conduits, said air and fuel conduits are substantially concentric, said second annular means comprises a collar intergral with the receptacle, the fuel conduit is telescopically fitted with said collar, and said releasable means detachably locks the end of said fuel conduit and said collar.

2. The apparatus of claim 1, wherein said receptacle has an upright front wall and a rear wall which slopes rearwardly progressing upwardly toward said open top, said walls defining an interior which in cross-section has substantially the shape of a cylindrical quadrant.

3. The apparatus of claim 3, wherein said receptacle and said shell are each constructable from a planar sheet metal pattern.

* * * * *